US005301236A

United States Patent [19]

Iizuka et al.

[11] Patent Number: 5,301,236

[45] Date of Patent: Apr. 5, 1994

[54] SYSTEM FOR PRODUCING STEREO-SIMULATED SIGNALS FOR SIMULATED-STEREOPHONIC SOUND

[75] Inventors: Tatsushi Iizuka; Satoshi Shinohara, both of Tokyo, Japan

[73] Assignee: Pioneer Electronic Corporation, Tokyo, Japan

[21] Appl. No.: 948,527

[22] Filed: Sep. 22, 1992

[30] Foreign Application Priority Data

Jan. 13, 1992 [JP] Japan ..... 4-023196

[51] Int. Cl.[5] ..... H04R 5/00

[52] U.S. Cl. ..... 381/17; 381/107

[58] Field of Search ..... 381/17, 107, 1, 27

[56] References Cited

U.S. PATENT DOCUMENTS 5,056,149 10/1991 Broadie ..... 381/17

FOREIGN PATENT DOCUMENTS 4-64607A2 1/1992 Japan .

*Primary Examiner*—Curtis Kuntz
*Assistant Examiner*—Mark D. Kelly
*Attorney, Agent, or Firm*—Nikaido, Marmelstein, Murray & Oram

[57] ABSTRACT

A first monophonic signal within a predetermined frequency range and a second monophonic signal at least outside of the predetermined frequency range are produced from a monophonic input signal. A simulated-stereo device is provided for dividing each of the first and second monophonic signals into stereo-simulated signals. The level of the first monophonic signal is compared with the level of the second monophonic signal. The level of the first stereo-simulated signal is attenuated when the level of the first monophonic signal is higher than the level of the outside monophonic signal.

7 Claims, 7 Drawing Sheets

SYSTEM FOR PRODUCING STEREO-SIMULATED SIGNALS FOR SIMULATED-STEREOPHONIC SOUND

FIELD OF THE INVENTION

The present invention relates to a system for producing stereophonic signals from a monophonic signal, for producing simulated-stereophonic sounds resembling stereophonic sounds, and more particularly to a system for localizing images of sounds in a predetermined frequency range such as human voice.

BACKGROUND OF THE INVENTION

Stereophonic sound is essentially different from monophonic sound in that the sound image of a particular sound source is localized. If the sound source moves, the sound image is accordingly moved. Thus, the stereophonic sound gives a sense of space in expanse and in perspective, in which the sound image is faithfully localized.

The sound image in a monophonic sound does not move. Therefore, if the sound image of the monophonic sound is moved, the sound can resemble stereophonic sound.

The localization of the sound image depends largely on the difference between sound pressure levels of sounds coming out of right and left loudspeakers. Another factor is the difference in phase, that is, the difference between times taken by the sounds from both speakers to reach the listener. The sound image is localized at a position from which sound with a higher sound pressure level is produced and at a position from which a sound with an advanced phase is produced.

There has been proposed a system for producing simulated-stereophonic sounds whose sound images are not localized by changing the sound level and phase.

FIGS. 9*a* to 9*g* show various conventional simulated-stereo devices. Referring to FIG. 9*a* a monophonic input signal is branched at a point P and applied to respective left and right loudspeakers 3 and 4 through filters 1 and 2 having different frequency responses. The filters 1 and 2 are, for example, a high-pass filter and a low-pass filter, respectively, the output signals of which are shown in FIG. 9*b*. Alternatively, the filters 1 and 2 may be complementary comb filters which give output signals shown in FIG. 9*c*, or all-pass filters which are different in group delay time as shown in FIG. 9*d*.

FIG. 9*e* shows a simulated stereo device having a reverberation chamber 5 wherein a loudspeaker 6 is provided and a pair of microphones 7 and 8 are provided at different positions. Monophonic sound generated by the loudspeaker 6 is picked up by the microphones 7 and 8 and reproduced through loudspeakers 9 and 10.

In another device which is shown in FIG. 9*f*, each monophonic input signal branched at a point P is applied to respective adders 11 and 12. The monophonic input signal is further applied to a delay circuit 14 through a level controller 13 and branched at a point Q. One of the branched signal is applied to the adder 11, while the other branched signal is applied to the adder 12 through a phase inverter 15. The adders 11 and 12 are connected to loudspeakers 11*a* and 12*a*, respectively.

In a device shown in FIG. 9*g*, monophonic input signals branched at a point P are applied to filters 16 and 17 which have different characteristics from each other.

The output characteristics of the filters 16 and 17 continuously change in accordance with the input signals branched from a point Q. Each of the output signals of the filters 16 and 17 are applied to respective loudspeakers 18 and 19 to be reproduced.

The simulated-stereo devices described above use either a level difference or a phase difference between sounds reproduced by the right and left loudspeakers. These methods are cited in "Spatial Hearing", Blauert, Morimoto, and Goto, 1988, Tokyo.

However, in the conventional simulated-stereo devices, the monophonic input signal is imparted with a similar stereophonic effect over the entire frequency range. Namely sound images of all sound source are moved. Therefore, when applied to a movie projector, all sorts of sounds are uniformly dispersed without localization in spite of the characteristic differences between the sounds in different frequency ranges, thereby giving a strange feeling to the audience, for example, in a case of a screen in which a singer sings a song, the position of the voice of the singer moves together with sounds of the background. This is very unnatural.

SUMMARY OF THE INVENTION

An object of the present invention is to provide a simulated-stereo device where stereophonic sound effect is controlled in response to the level of the sound of a predetermined frequency range, such as vocal frequency range, so that the reproduced vocal sound can be localized.

According to the present invention, there is provided a simulated-stereo system for producing stereo-simulated signals from a monophonic input signal, comprising a first device applied with the monophonic input signal for transmitting a first monophonic signal within a predetermined frequency range, a second device applied with the monophonic input signal for transmitting a second monophonic signal at least outside the predetermined frequency range, a simulated-stereo device dividing each of the monophonic signals into stereo-simulated signals, a device for comparing the level of the first monophonic signal with the level of the second monophonic signal, and a device for attenuating the level of the stereo-simulated signal when the level of the first monophonic signal is higher than the level of the second monophonic signal.

In one aspect of the invention, the comparing means compares the level of the first monophonic signal with the level of the monophonic input signal.

In another aspect of the invention, the comparing means compares the level of the second monophonic signal with a level of the monophonic input signal.

In another aspect of the invention, the comparing means compares the level of the first monophonic signal with a predetermined reference value.

In another aspect of the invention, the comparing means compares the level of the second monophonic signal with a predetermined reference value.

Thus, in accordance with the present invention, the level of the stereo-simulated signal in the predetermined frequency range such as a vocal signal is attenuated when the level of the monophonic vocal signal is higher than that of signals other than the vocal signal. The vocal sound is accordingly prevented from dispersing, but is localized instead.

The other objects and features of this invention will become understood from the following description with reference to the accompanying drawings.

DETAILED DESCRIPTION OF THE PREFERRED EMBODIMENTS

Figure 1:
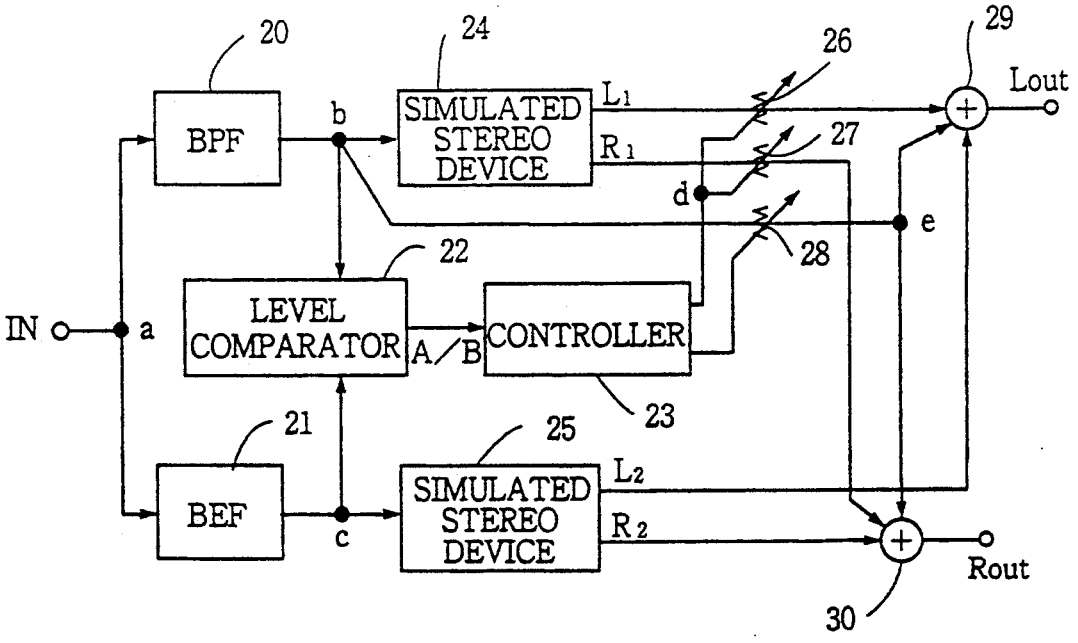
FIG. 1 is a block diagram of a simulated-stereo system according to the present invention.

Referring to FIG. 1, monophonic input signals branched at a branching point a are applied to a band-pass filter (BPF) 20 and a band-elimination filter (BEF) 21. The BPF transmits vocal signals, which are within a frequency range of several hundred hertz to several kilohertz. On the other hand, the BEF 21 eliminates the vocal signals. The output signals of the BPF 20 and BEF 21 are applied to simulated stereo devices 24 and 25, respectively. Each of the simulated-stereo devices 24 and 25 uses any one of the methods described in FIGS. 9*a* to 9*g* to divide the monophonic signals into right and left stereo-simulated signals R1, R2, and L1, L2. The signals are fed to respective adders 30 and 29 which are connected to right and left loudspeakers (not shown). Namely, the adder 29 is applied with a left stereo-simulated vocal signal L1 from the simulated-stereo device 24 through an attenuator 26, a left stereo-simulated non-vocal signal L2 from the simulated-stereo device 25, and a monophonic vocal signal coming from the BPF 20 branched at a point b and passing through an attenuator 28, thereby producing a left channel output signal Lout. The adder 30 is applied with a right stereo-simulated vocal signal R1 coming from the simulated-stereo device 24 and passing through an attenuator 27, right stereo-simulated non-vocal signal R2 from the simulated-stereo device 25, and a monophonic vocal signal branched at a point e, thereby producing a right channel output signal Rout. The attenuators 26 to 28 are provided to control the level of the vocal signals applied to each adders 29, 30.

Figure 2:
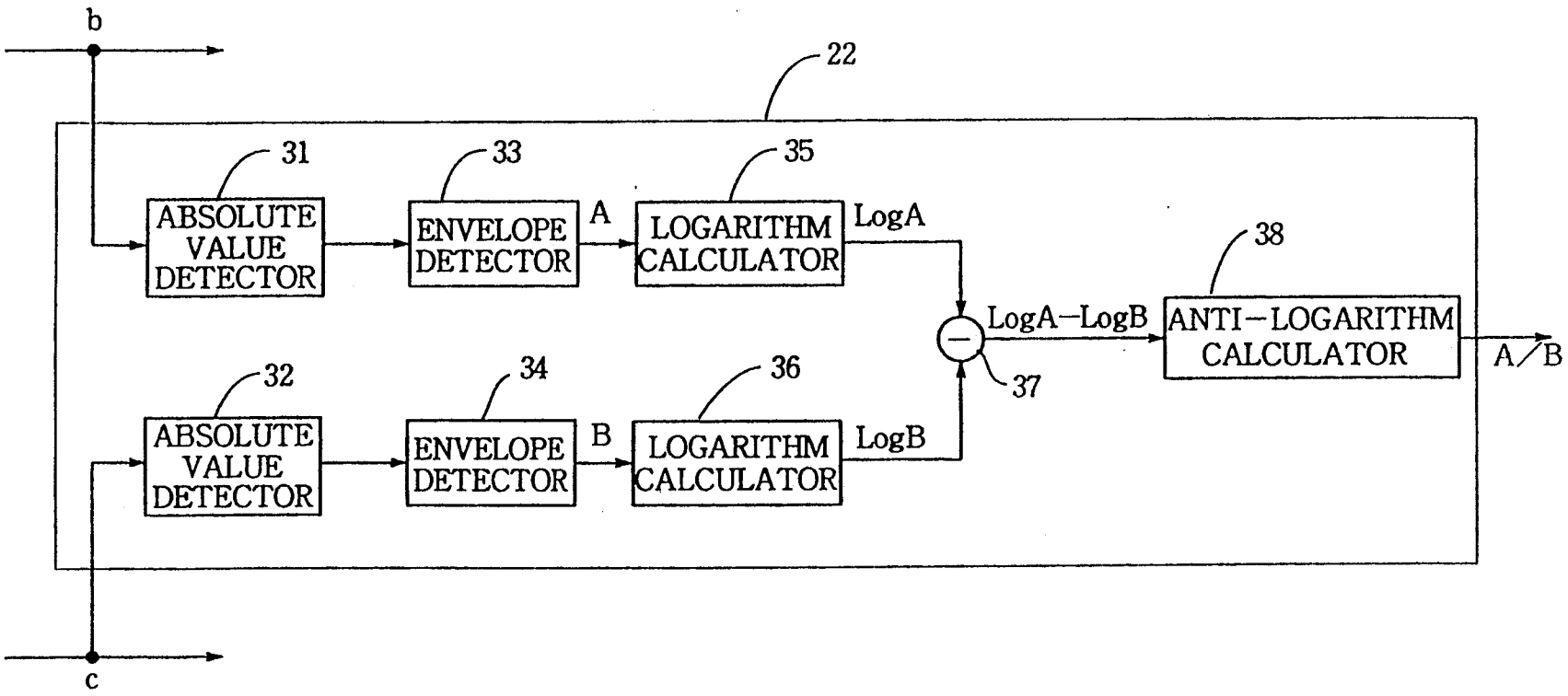
FIG. 2 is a block diagram of a level comparator provided in the system of FIG. 1.

In order to control the attenuators 26, 27 and 28, the system of the present invention is provided with a level comparator 22 and a controller 23. Referring to FIG. 2, the level comparator 22 has an absolute value detector 31 to which the monophonic vocal signal from the BPF 20, branched at the point b, is fed. The absolute value detector 31 detects the absolute value of the signal wave of the output of BPF 20. The output signal of the detector 31 is applied to an envelope detector 33 which comprises, for example, a low-pass filter, so as to detect an envelope of the wave. In other words, an average value A of the wave is obtained. The average value A is applied to a logarithm calculator 35 where Log A is obtained. The level comparator 22 further has an absolute value detector 32 to which a monophonic non-vocal signal transmitted from the BEF 21 and branched at a point c is fed and in which the absolute value of the signal wave is detected. An envelope detector 34 detects the average value B. The average value B is fed to a logarithm calculator 36 to calculate Log B.

The logarithms Log A and Log B are fed to a substracter 37 where the calculation (Log A−Log B) is made. The difference between Log A and Log B is converted into an anti-logarithm at a calculator 38 and A/B is obtained.

Referring back to FIG. 1, this A/B is applied to the controller 23 which controls the attenuators 26 to 28 in accordance with the value of A/B. Namely, when A/B is larger than 1, it means that the level of the vocal signal is higher than that of the non-vocal signal, the controller 23 operates to increase the attenuation of the attenuators 26 and 27 and to decrease the attenuation of the attenuator 28.

On the other hand, when A/B is smaller than 1 or equal to 1, the level of the vocal signal is smaller or the same as the level of the non-vocal signal. Accordingly the attenuators 26 and 27 are controlled to decrease the attenuation thereof and the attenuator 28 is controlled to increase the attenuation.

In order to render a gradual change of the attenuations, the controller 23 is preferably adapted to be operated with an attack time of several milliseconds and a decay time of several tens of milliseconds.

The operation of the system is described below. The monophonic signal is applied to the BPF 20 and BEF 21 from which the vocal signal and the non-vocal signals are derived, respectively. The vocal signal is applied to the simulated-stereo device 24 wherein the signal is divided into the left stereo-simulated vocal signal L1 and the right stereo-simulated vocal signal R1, which are fed to the adders 29 and 30 through the attenuators 26 and 27, respectively. The monophonic vocal signal from the BPF 20 is further fed to the adders 29 and 30 through the attenuator 28. The non-vocal signal is fed to the simulated-stereo device 25 so that the monophonic vocal signal is divided into the left stereo-simulated non-vocal signal L2 and the right stereo-simulated non-vocal signal R2. The left signal L2 and the right signal R2 are applied to adders 29 and 30, respectively. Thus the monophonic signal is converted into simulated-stereophonic sound by the right and left loudspeakers.

At the same time, the monophonic vocal signal and the monophonic non-vocal signal are fed to the level comparator 22 where the levels thereof are compared. Namely, the absolute values of the vocal signal are obtained in the absolute value detector 31. The average A of the absolute values is obtained in the envelope detector 33 and converted into the logarithm Log A by the logarithm calculator 35. Similarly, the absolute value of the non-vocal signal is obtained in the absolute value detector 32 and the average B thereof is obtained at the envelope detector 34. The logarithm calculator 36 calculates Log B. Thereafter, Log B is subtracted from Log A by the substracter 37 and the difference between Log A and Log B is converted into anti-logarithm, and A/B is obtained by the anti-logarithm calculator 38.

The value of A/B, which represents the rate of the level of the vocal signal to the level of the non-vocal signal, is applied to the controller 23 which controls the attenuators 26, 27 and 28 in accordance with the value thereof. Thus the levels of the vocal signals applied to the right and left speakers are controlled. When the rate A/B is larger than 1, that is, the voice is larger than other sounds in the background, the attenuations of the attenuators 26 and 27 are increased and the attenuation of the attenuator 28 is decreased. Hence the levels of the right and left stereo-simulated vocal signals R1 and L1 are decreased. To the contrary, the level of the monophonic vocal signal equally applied to the right and left loudspeakers is increased. As a result, only the sounds in the background has stereo effect and the vocal sound image is focused at one place.

If the rate A/B becomes 1 or smaller, the attenuations of the attenuators 26 and 27 are decreased and the attenuation of the attenuator 28 is increased, thereby raising the level of the vocal signals R1 and L1 and decreasing the level of the monophonic vocal signal. Thus the vocal sound as well as other sounds is effectively imparted with stereophonic effect.

Hence with the simulated-stereo system of the present invention, in a monophonically recorded movie, the human voice is focused at the center of the screen, thereby providing a natural audio effect.

Figure 3:
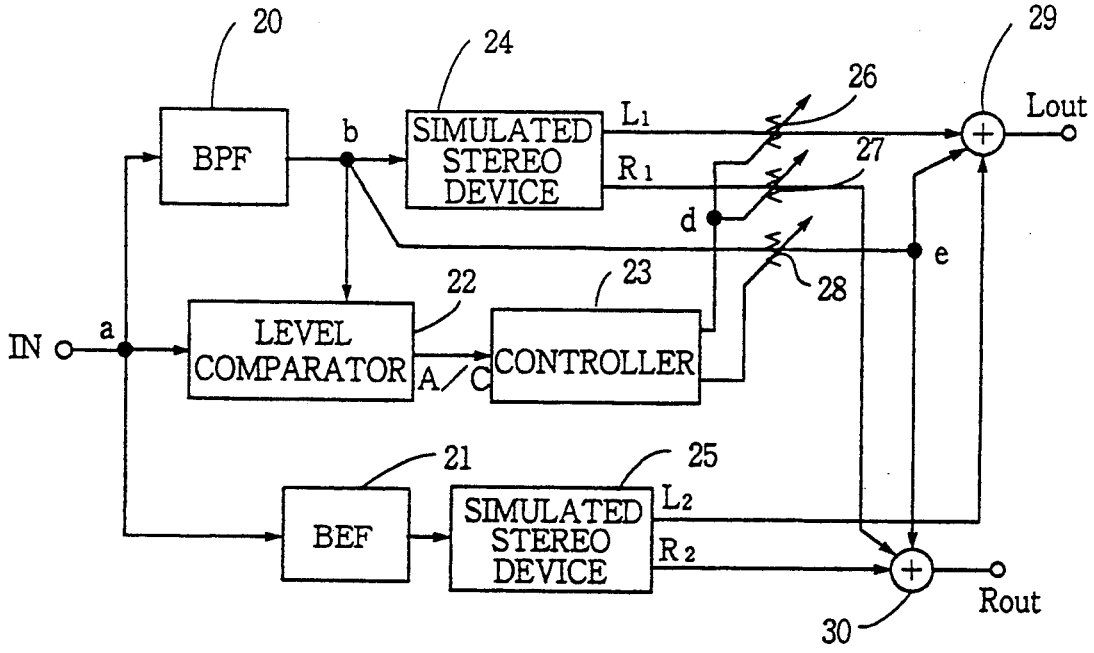
FIGS. 3 and 4 are block diagrams showing modifications of the simulated-stereo system of FIG. 1.

FIG. 3 shows the modification of the embodiment of FIG. 1. In the system, the value Log C which is logarithm of the average of the monophonic input signal separated at the point a is obtained in the level comparator 22. The level of the vocal signal is determined in dependency on a rate A/C that is the rate of the level A of the vocal signal to the level C of the entire monophonic input signal. The rate A/C is calculated in the same manner as described in FIG. 2. When the rate A/C is higher than a predetermined reference value, for example 0.5, the attenuations of the attenuators 26 and 27 are increased and the attenuation of the attenuator 28 is decreased, thereby decreasing the level of the vocal signals R1 and L1. When the rate A/C is equal to or smaller than the reference value, the attenuations of the attenuators 26 and 27 are decreased and that of the attenuator 28 is increased, so that the level of the vocal signals R1 and L1 are increased.

Figure 4:
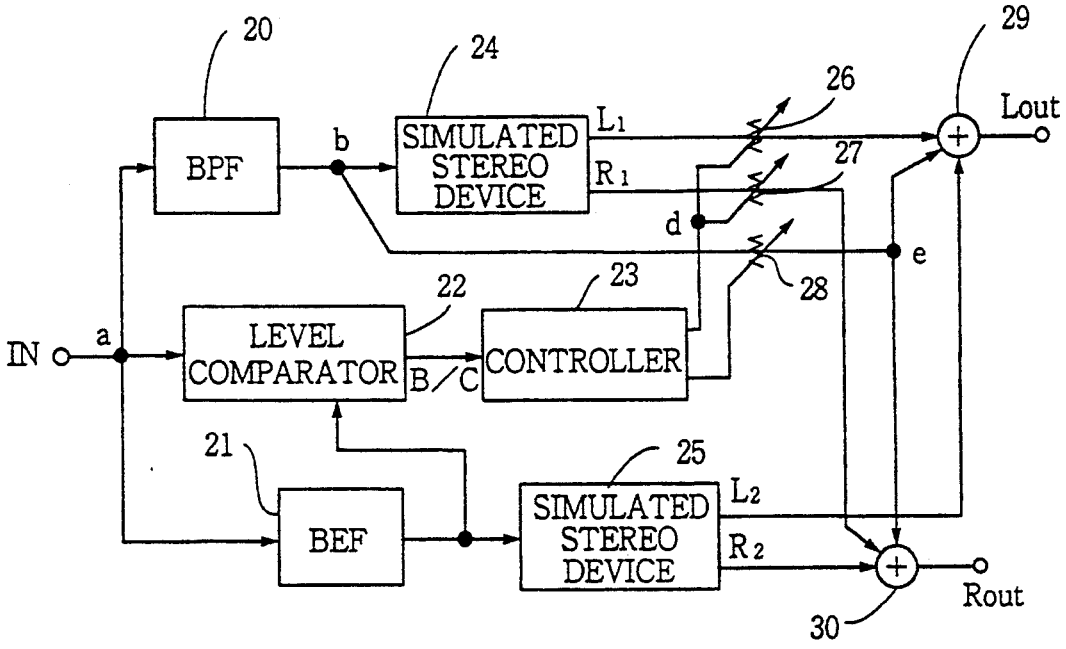

FIG. 4 shows a further modification of the embodiment. In the system, the monophonic input signal and the monophonic non-vocal signal are fed to the level comparator 22. A rate B/C of the non-vocal signal to the level of the entire monophonic signal C is compared with a predetermined reference value such as 0.5. When the rate B/C is smaller than the reference value, the attenuations of the attenuators 26 and 27 are decreased and the attenuation of the attenuator 28 is increased. The same effect as those of the embodiments described above is obtained.

The existence of voice, the image of which is preferably localized, can be determined not only when the level of the vocal signal is higher than the level of the non-vocal signal as described above, but in accordance with other reference levels. Since the rates A/B and A/C change in accordance with gain and frequency response of the circuit being used, the reference value may be properly changed from 1 and 0.5.

Figure 5:
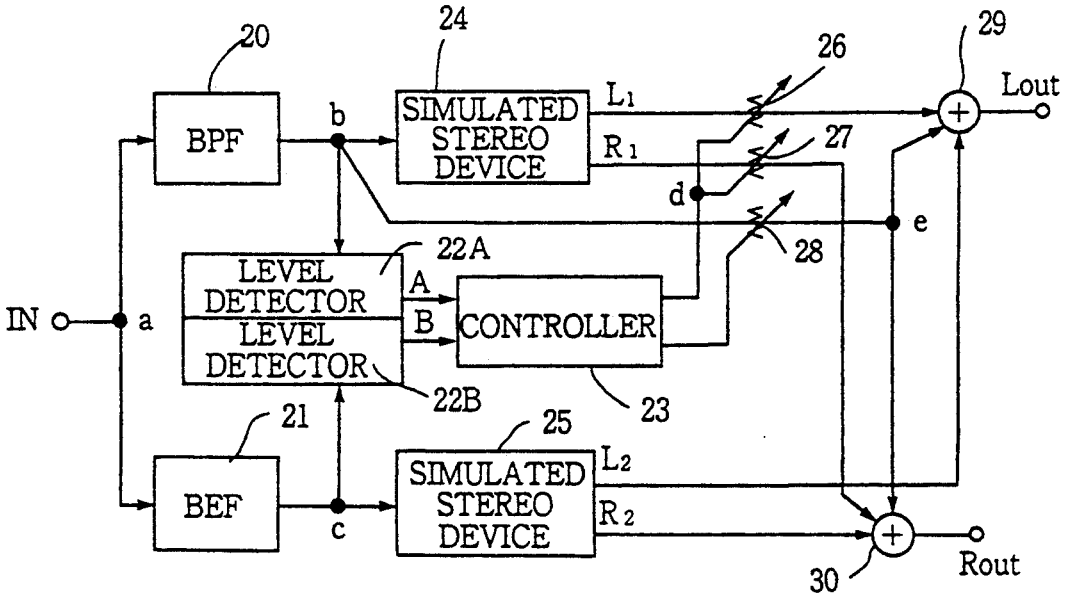
FIG. 5 is a block diagram showing a second embodiment of the simulated-stereo system according to the present invention.

FIG. 5 shows a second embodiment of the present invention wherein the level comparator 22 is substituted with a level detector 22A and a level detector 22B to which the monophonic vocal signal or the non-vocal signal is applied. Either of the level detectors 22A and 22B is employed. Other parts are the same as the system shown in FIG. 1, and therefore designated with the same references.

Figure 6:
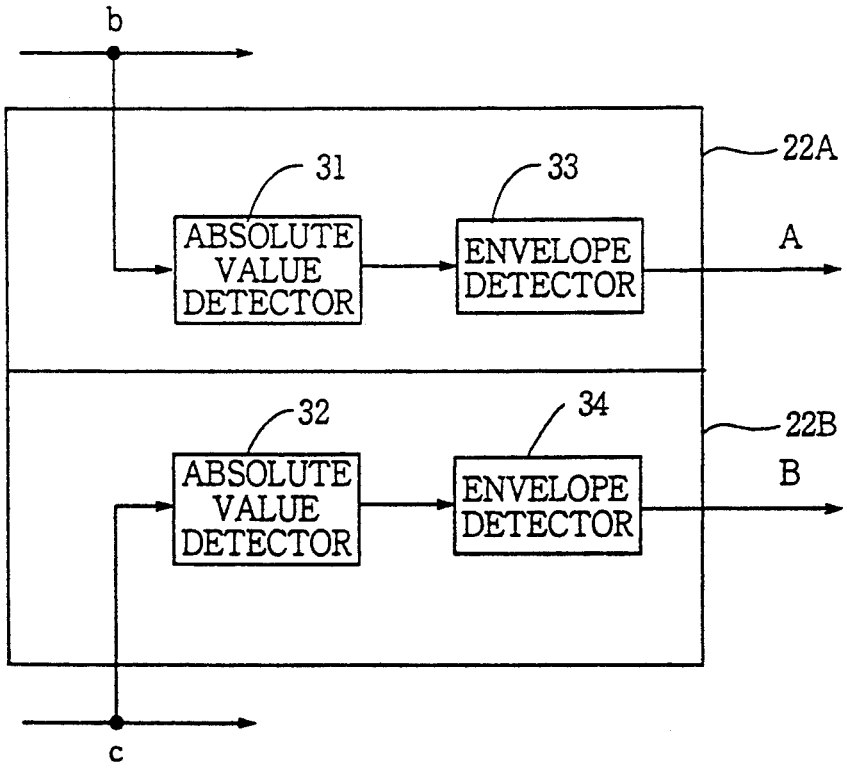
FIG. 6 is a block diagram of a level detector provided in the system of FIG. 5.
Figure 7:
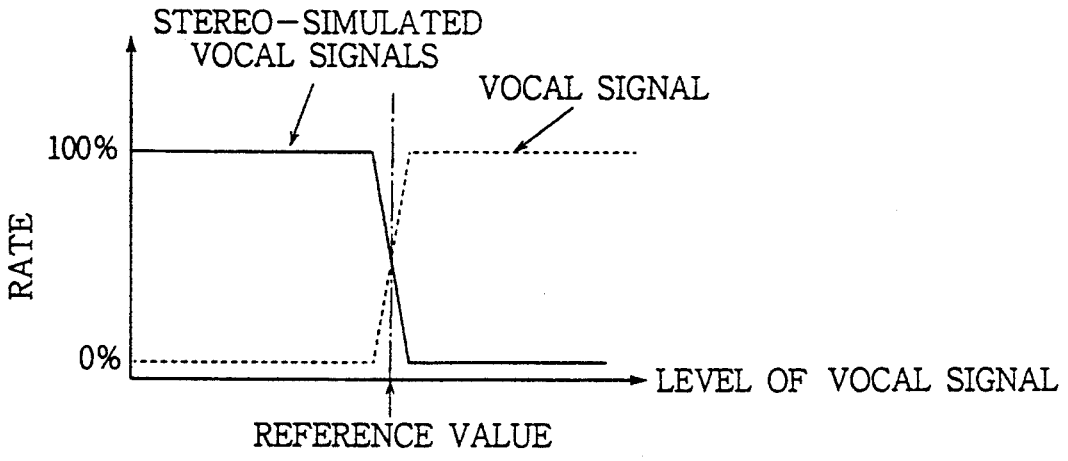
FIGS. 7 and 8 are graphs showing examples of attenuation characteristics of stereo-simulated signals in the system of FIG. 5.

Referring to FIG. 6, in the embodiment using the level detector 22A, the level detector 22A has the absolute value detector 31 and the envelope detector 33. The functions of the system are already described. Thus, the averages values A and B of the absolute values of the signals are obtained at the level detector 22A and fed to the controller 23 which controls the attenuators 26 to 28 in accordance with a predetermined reference value as shown in FIG. 7. The reference value corresponds to an average level of vocal signals which is stored in a memory (not shown) provided in the controller 23. When A that is the average level of the input vocal signal is larger than the reference value, the attenuators 26 an 27 are operated to decrease the stereo-simulated vocal signals R1 and L1 to zero as shown by a solid line and the attenuator 28 is operated to increase the vocal signal from the branch point b to the maximum as shown by a dotted line. On the other hand, when the level A is smaller than the reference value, the levels of the stereo-simulated vocal signals R1 and L1 are increased to the maximum.

Figure 8:
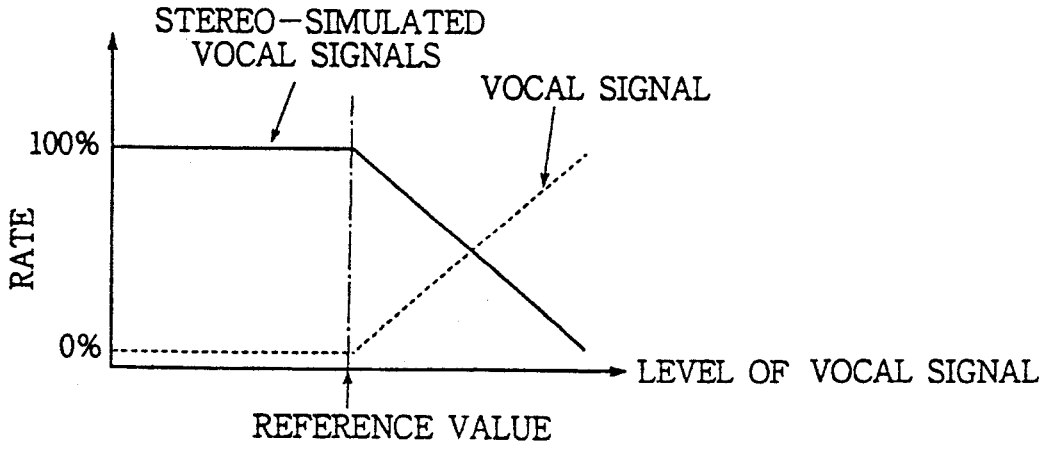
Figure 9A:
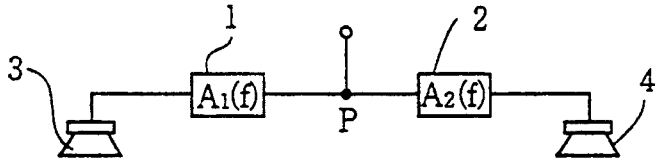
PRIOR ART FIG.9 a
FIG. 9*a* is a schematic diagram showing a conventional simulated-stereo device.
Figure 9B:
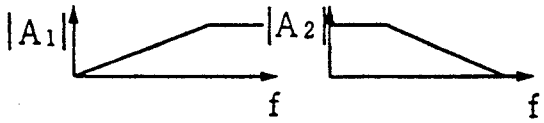
FIGS. 9*b* to 9*d* show characteristics of filters provided in the simulated-stereo device of FIG. 9*a*.
Figure 9C:
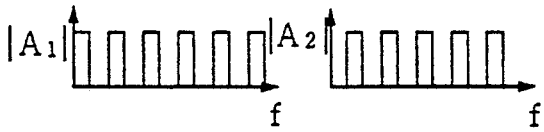
Figure 9D:
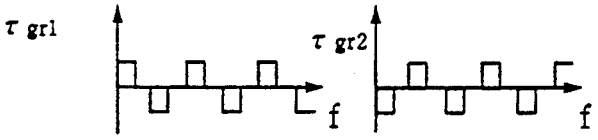
Figure 9E:
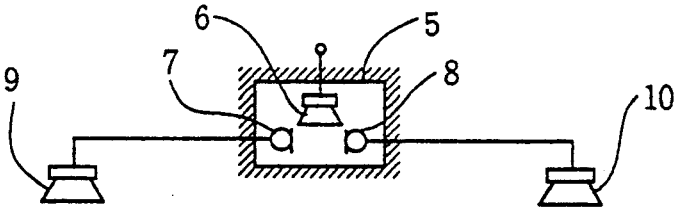
FIGS. 9*e* to 9*g* are schematic diagrams of other conventional simulated-stereo devices.
Figure 9F:
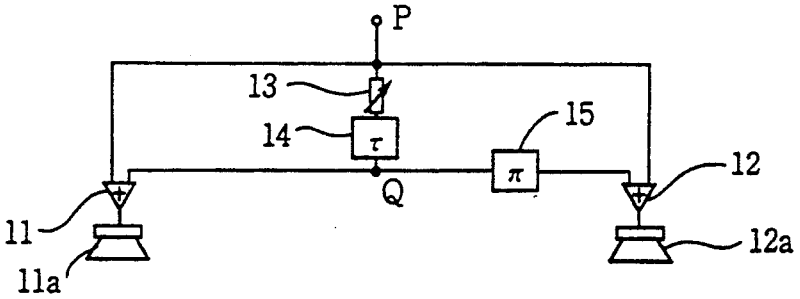
Figure 9G:
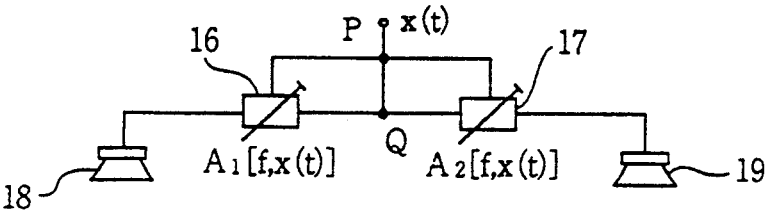

As shown in FIG. 8, the present embodiment may be modified to gradually control the levels of the stereo-simulated vocal signals and the monophonic vocal signal in accordance with the level A.

In embodiment of the level detector 22B, the level detector 22B has the absolute value detector 32 and the envelope detector 34 and its output is compared with the reference value at the controller 23. In such a case, the levels of the stereo-simulated vocal signals are minimized when the level of the non-vocal signal is smaller than a reference value and maximized when larger.

The level detector 22A may be modified to detect the levels of both the vocal and non-vocal signals. The difference between the levels are calculated so as to control the attenuators 26 to 28, accordingly.

The second embodiment of the present invention is convenient in that the level detector 22A has a simple construction, obviating the calculators 35, 36 and 38 provided in the level comparator 22 of FIG. 2.

Although two simulated stereo devices 24 and 25 are provided in each of the above-described embodiments, a single device may be used to obtain both of the simulated-stereo vocal and non-vocal signals. The attenuating characteristics of the attenuators 26 to 28 may be either stepwise as shown in FIG. 7, or gradual as shown in FIG. 8. The predetermined frequency range need not be confined to the voice frequency range, but may be set at a frequency range corresponding to sounds such as noise caused by cars.

The present invention may be applied to a simulated-stereo system which produces three or more output channel signals. Moreover, the simulated-stereo system of the present invention may comprise a digital signal processor (DSP) instead of the analog circuit, where the operation of each sections are programmed.

From the foregoing it will be understood that the present invention provides a simulated-stereo system where the image of sounds in a particular frequency range is localized when these sounds are large and dispersed when small. Hence, if the system is applied to a movie projector, for example, words can be heard as though actually spoken by a person on the screen.

While the presently preferred embodiments of the present invention have been shown and described, it is to be understood that these disclosures are for the purpose of illustration and that various changes and modifications may be made without departing from the scope of the invention as set forth in the appended claims.

What is claimed is:

1. A system for producing right and left stereo-simulated signals from a monophonic input signal comprising:

a first filter responsive to the monophonic input signal for transmitting a first monophonic signal which is within a predetermined frequency range;

a second filter responsive to the monophonic input signal for transmitting a second monophonic signal which is outside the predetermined frequency range;

a first simulated-stereo device for dividing the first monophonic signal into right and left first stereo-simulated signals which are within the predetermined frequency range;

a second simulated-stereo device for dividing the second monophonic signal into right and left second stereo-simulated signals which are outside the predetermined frequency range;

level detecting means for detecting at least a level of one of the first and second monophonic signals and generating a control signal therefrom;

a controller for controlling a level of the right and left signals of one of the first and second stereo-simulated signals in accordance with said control signal;

an adder means for adding the right first stereo-simulated signal, the right second stereo-simulated signal and the first monophonic signal to produce an output right stereo-simulated signal, and for adding the left first stereo-simulated signal, the left second stereo-simulated signal and the first monophonic signal to produce an output left stereo-simulated signal.

2. A system according to claim 1, wherein the level detecting means compares a level of the first monophonic signal with a level of the second monophonic signal, and the controller attenuates the level of the right and left first stereo-simulated signals when the level of the first monophonic signal is higher than the level of the second monophonic signal.

3. A system according to claim 1, wherein the level detecting means compares the level of the first monophonic signal with the level of the monophonic input signal, and the controller attenuates the level of the right and left first stereo-simulated signals when the level of the first monophonic signal is higher than the level of the monophonic input signal.

4. A system according to claim 1, wherein the level detecting means compares the level of the second monophonic signal with a level of the monophonic input signal, and the controller attenuates the level of the right and left first stereo-simulated signals when the level of the second monophonic signal is higher than the level of the monophonic input signal.

5. A system according to claim 1, wherein the level detecting means compares the level of the first monophonic signal with a predetermined reference value, and the controller attenuates the level of the right and left first stereo-simulated signals when the level of the first monophonic signal is higher than the reference value.

6. A system according to claim 1, wherein the level detecting means compares the level of the second monophonic signal with a predetermined reference value, and the controller attenuates the level of the right and left first stereo-simulated signals when the level of the second monophonic signal is higher than the level of the reference value.

7. A method of producing right and left stereo-simulated signals from a monophonic input signal comprising the steps of:

transmitting a first monophonic signal which is within a predetermined frequency range in response to the monophonic input signal;

transmitting a second monophonic signal which is outside the predetermined frequency range in response to the monophonic input signal;

dividing the first monophonic signal into right and left first stereo-simulated signals;

dividing the second monophonic signal into right and left second stereo-simulated signals;

detecting either the level of at least one of the first and second monophonic signals or the ratio of the first and second monophonic signals and generating a control signal therefrom.

controlling a level of the right and left signals of the first and second stereo-simulated signals based on said control signal; and adding the right first stereo-simulated signal, the right second stereo-simulated signal and the first monophonic signal to produce an output right stereo-simulated signal, and adding the left first stereo-simulated signal, the left second stereo-simulated signal and the first monophonic signal to produce an output left stereo-simulated signal.

* * * * *